US007114579B2

(12) United States Patent
Hutchinson

(10) Patent No.: US 7,114,579 B2
(45) Date of Patent: Oct. 3, 2006

(54) SYSTEM AND METHOD FOR INTERPRETING DRILLING DATE

(76) Inventor: Mark W. Hutchinson, Willowbank House, 84 Station Road, Marlow, Bucks SL7 1NX (GB)

( * ) Notice: Subject to any disclaimer, the term of this patent is extended or adjusted under 35 U.S.C. 154(b) by 8 days.

(21) Appl. No.: 10/958,540

(22) Filed: Oct. 4, 2004

(65) Prior Publication Data

US 2005/0087367 A1 Apr. 28, 2005

Related U.S. Application Data

(63) Continuation of application No. PCT/US03/10280, filed on Apr. 3, 2003.

(60) Provisional application No. 60/374,117, filed on Apr. 19, 2002.

(51) Int. Cl.
*E21B 47/09* (2006.01)

(52) U.S. Cl. ..... 175/40; 166/250.01; 73/152.43

(58) Field of Classification Search ..... 175/40, 175/45, 24, 25, 26; 166/250.01; 702/9; 73/152.43, 152.44, 152.46, 152.49
See application file for complete search history.

(56) References Cited

U.S. PATENT DOCUMENTS 4,685,329 A * 8/1987 Burgess ..... 73/152.44
4,958,125 A * 9/1990 Jardine et al. ..... 324/162
5,454,436 A * 10/1995 Jardine et al. ..... 175/40
5,952,569 A * 9/1999 Jervis et al. ..... 73/152.01
6,234,250 B1 * 5/2001 Green et al. ..... 166/250.03
6,237,404 B1 * 5/2001 Crary et al. ..... 73/152.03
6,408,953 B1 * 6/2002 Goldman et al. ..... 175/39
6,820,702 B1 * 11/2004 Niedermayr et al. ..... 175/57
2003/0151977 A1 * 8/2003 Shah et al. ..... 367/82

* cited by examiner

*Primary Examiner*—David Bagnell
*Assistant Examiner*—Daniel P Stephenson
(74) *Attorney, Agent, or Firm*—Richard A. Fagin

(57) ABSTRACT

A method is disclosed for identifying potential drilling hazards in a wellbore, including measuring a drilling parameter, correlating the parameter to depth in the wellbore at which selected components of a drill string pass, determining changes in the parameter each time the selected components pass selected depths in the wellbore, and generating a warning signal in response to the determined changes in the parameter. Another disclosed method includes determining times at which a drilling system is conditioning the wellbore, measuring torque, hookload and drilling fluid pressure during conditioning, and generating a warning signal if one or more of maximum value of measured torque, torque variation, maximum value of drill string acceleration, maximum value of hookload and maximum value of drilling fluid pressure exceeds a selected threshold during reaming up motion of the drilling system.

44 Claims, 9 Drawing Sheets

SYSTEM AND METHOD FOR INTERPRETING DRILLING DATE

CROSS-REFERENCE TO RELATED APPLICATIONS

This is a continuation of International Patent Application No. PCT/US03/10280 filed on Apr. 3, 2003. Priority is claimed from U.S. Provisional Application No. 60/374,117 filed on Apr. 19, 2002.

STATEMENT REGARDING FEDERALLY SPONSORED RESEARCH OR DEVELOPMENT

Not applicable.

BACKGROUND OF THE INVENTION

1. Field of the Invention

This invention relates generally to the field of drilling wellbores through the earth. More specifically, the invention relates to systems and methods for acquiring data related to wellbore drilling, characterizing the data according to the particular aspect of drilling being performed during acquisition, and determining the possibility of encountering particular drilling hazards by analyzing the data thus characterized.

2. Background Art

Drilling wellbores through the earth includes "rotary" drilling, in which a drilling rig or similar lifting device suspends a drill string. The drill string turns a drill bit located at one end of the drill string. Equipment forming part of the drilling rig and/or an hydraulically operated motor disposed in the drill string rotate the drill bit. The drilling rig includes lifting equipment which suspends the drill string so as to place a selected axial force on the drill bit as the bit is rotated. The combined axial force and bit rotation causes the bit to gouge, scrape and/or crush the rocks, thereby drilling a wellbore through the rocks.

Typically a drilling rig includes liquid pumps for forcing a drilling fluid called "drilling mud" through the interior of the drill string. The drilling mud is ultimately discharged through nozzles or water courses in the bit. The drilling mud lifts drill cuttings from the wellbore and carries them to the earth's surface for disposition. Other types of rigs may use compressed air as the fluid for lifting cuttings and cooling the bit. The drilling mud also provides hydrostatic pressure to prevent fluids in the pore spaces of the drilled formations from entering the wellbore in an uncontrolled manner ("blowout"), and includes materials which form an impermeable barrier ("mud cake") to reduce drilling fluid loss into permeable formations in which the hydrostatic pressure inside the wellbore is greater than the fluid pressure in the formation (preventing "lost circulation").

The process of drilling wellbores through the earth includes a number of different operations performed by the drilling rig and its operating crew other than actively turning and axially pushing the drill bit as described above. It is necessary, for example, to add segments of drill pipe to the drill string in order to be able to deepen the well beyond the end of the length of the drill string. It is also necessary, for example, to change the drill bit from time to time as the drill bit becomes worn and no longer drills through the earth formations efficiently. The foregoing examples are not an exhaustive list of such non-drilling operations performed by a typical drilling rig, but are recited here to explain limitations of prior art drilling data recording and analysis systems.

Drilling data recording and analysis systems known in the art make recordings of measurements made by various sensors on the rig equipment, and in some cases from sensors disposed within the drill string, with respect to time. A record of the position of the drill string within the wellbore is also made with respect to time (a time/depth index). Typically, prior art systems use the recorded data and recorded time/depth index to make a final, single record of rig operation and sensor measurement data with respect to depth, wherein the presented data represent monotonic increase with respect to depth. For example, measurements made by sensors in the drill string performed "while drilling" are typically only presented in the final record for the first time each such sensor passes each depth in the wellbore. Data measured during subsequent movement of particular sensors by particular depth intervals may be omitted from the final record.

As is well known in the art, however, a substantial amount of the time during drilling operations the depth of the wellbore is not, in fact, increasing monotonically, but may include operations in which the drill string, for example, is removed from the wellbore, is moved up and down repeatedly, or remains in a fixed axial position while it is rotated and the drilling fluid is circulated. The rig operations which do not result in monotonically increasing depth with respect to time may incur exposure to drilling hazards such as stuck pipe, blowout or lost drilling fluid ("lost circulation"). Drilling data recording systems known in the art do not make effective use of drilling parameters measured during non drilling operations for the purpose of identifying and mitigating the risk of encountering drilling hazards.

It is also known in the art that certain drilling parameters measured during non-drilling operations, such non drilling operations including, for example, withdrawing the drill string from the wellbore ("tripping out"), inserting the drill string into the wellbore ("tripping in") and adding a segment of drill pipe to the drill string to enable further drilling ("making a connection"), may change over time due to conditions in the wellbore changing over time. For example, a formation that has a fluid pressure therein substantially lower than the hydrostatic pressure of the wellbore may cause a large amount of "filter cake" (compressed drilling fluid solids) to build up at the wellbore wall. Over time this filter cake may become so thick as to make it difficult to remove the drill string from the wellbore, or may risk the drill string becoming stuck in the wellbore. Drilling parameters which may change over time may include, for example, the amount of force needed to withdraw the drill string from the wellbore, the amount of torque needed to overcome friction in the wellbore and resume rotary drilling after making a connection, and an amount of fluid pressure in the wellbore due to moving the drill string axially along the wellbore ("swab" and "surge" pressures). It is desirable to have a system which records drilling parameters with respect to time, determines wellbore depth of the drill string with respect to time, automatically determines the actual operation performed by the drilling rig and analyzes data with respect to the operation, and provides the wellbore operator and/or drilling rig operator with indications of unsafe conditions in the wellbore as the drilling parameters change over time.

SUMMARY OF THE INVENTION

One aspect of the invention is a method is for identifying potential drilling hazards in a wellbore. The method according to this aspect of the invention includes measuring a drilling parameter, correlating the drilling parameter to a depth in the wellbore at which selected components of a drill string pass, determining changes in the measured parameter each time the selected components of the drill string pass selected depths in the wellbore, and generating a warning signal in response to the determined changes in the measured parameter.

Another aspect of the invention is a method for determining potential drilling hazards in a wellbore. A method according to this aspect of the invention includes determining times at which a drilling system is conditioning the wellbore. At least one of a parameter related to drill string rotation, drill string axial motion and drilling fluid pressure during the conditioning is measured during the conditioning, and a warning signal is generated if at the at least one parameter exceeds a selected threshold during reaming up operation of the drilling system.

Another aspect of the invention is a method for determining whether a wellbore conditioning time during drilling operations is sufficient to continue drilling safely prior to making a connection. In a method according to this aspect of the invention, a conditioning time is measured before making successive drill string connections. Torque is measured during the conditioning. A difference between the maximum and minimum values of torque measured is compared to the conditioning time at each such connection. A minimum safe conditioning time is determined from the comparison when the measured torque difference falls below a selected threshold.

In another aspect, a method according to the invention includes determining a length of time for each interval of drilling operations that a drilling system is performing conditioning of the wellbore, measuring, during after each time the system performs the conditioning at least one of a maximum excess torque, a maximum overpull and a maximum drilling fluid pressure, and generating a warning signal if the at least one of the maximum excess torque, the maximum overpull and the maximum drilling fluid pressure exceeds a selected threshold.

Other aspects of the invention include computer programs stored in a computer readable medium. The computer programs include logic operable to cause a programmable computer to perform steps including those described above in other aspects of the invention.

Still other aspects and advantages of the invention will be apparent from the following description and the appended claims.

DETAILED DESCRIPTION

Figure 1:
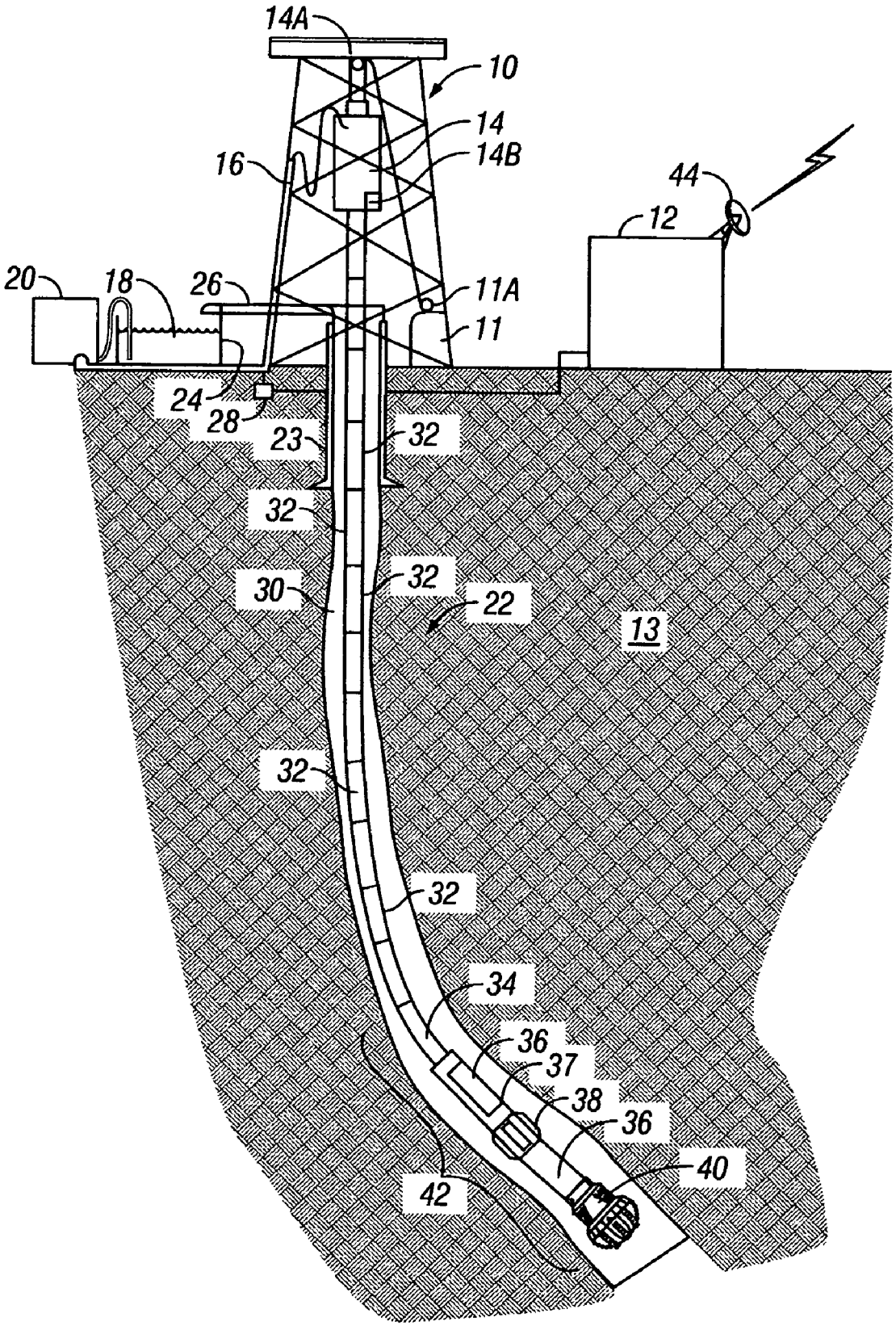
FIG. 1 shows a typical wellbore drilling operation.

FIG. 1 shows a typical wellbore drilling system which may be used with various embodiments of a method according to the invention. A drilling rig 10 includes a drawworks 11 or similar lifting device known in the art to raise, suspend and lower a drill string. The drill string includes a number of threadedly coupled sections of drill pipe, shown generally at 32. A lowermost part of the drill string is known as a bottom hole assembly ("BHA") 42, which includes at its lowermost end in the embodiment of FIG. 1, a drill bit 40 to cut through earth formations 13 below the earth's surface. The BHA 42 may include various devices such as heavy weight drill pipe 34, and drill collars 36. The BHA 42 may also include one or more stabilizers 38 that include blades thereon adapted to keep the BHA approximately in the center of the wellbore 22 during drilling. In various embodiments of a drilling system, one or more of the drill collars 36 may include a measurement while drilling (MWD) sensor and telemetry unit (collectively "MWD system"), shown generally at 37. The sensors and purpose of the MWD system 37 and the types of sensors therein will be further explained below with reference to FIG. 2.

The drawworks 11 is typically operated during active drilling so as to apply a selected axial force (called weight on bit—"WOB") to the drill bit 40. Such axial force, as is known in the art, results from the weight of the drill string, a large portion of which is suspended by the drawworks 11. The unsuspended portion of the weight of the drill string is transferred to the bit 40 as axial force. The bit 40 is rotated by turning the pipe 32 using a rotary table/kelly bushing (not shown in FIG. 1) or preferably a top drive 14 (or power swivel) of any type well known in the art. While the pipe 32 (and consequently the BHA 42 and bit 40) as well is turned, a pump 20 lifts drilling fluid ("mud") 18 from a pit or tank 24 and moves it through a standpipe/hose assembly 16 to the top drive 14 so that the mud 18 is forced through the interior of the pipe segments 32 and then the BHA 42. Ultimately, the mud 18 is discharged through nozzles or water courses (not shown) in the bit 40, where it lifts drill cuttings (not shown) to the earth's surface through an annular space between the wall of the wellbore 22 and the exterior of the pipe 32 and the BHA 42. The mud 18 then flows up through a surface casing 23 to a wellhead and/or return line 26. After removing drill cuttings using screening devices (not shown in FIG. 1), the mud 18 is returned to the tank 24.

The standpipe system 16 in this embodiment includes a pressure transducer 28 which generates an electrical or other type of signal corresponding to the mud pressure in the standpipe 16. The pressure transducer 28 is operatively connected to systems (not shown separately in FIG. 1) inside a recording unit 12 for decoding, recording and interpreting signals communicated from the MWD system 37. As is known in the art, the MWD system 37 includes a device, which will be explained below with reference to FIG. 2, for modulating the pressure of the mud 18 to communicate data to the earth's surface. In some embodiments of a method according to the invention, the pressure measured by the transducer 28 is used in the recording unit to determine the presence of certain types of drilling hazards. Pressure measurements may also be used in some embodiments to determine whether the mud pump 20 is operating or turned off, the latter determination used for purposes of determining what particular operation the rig 10 is performing at any point in time. An example of determining rig operation will be explained below with reference to FIG. 8. The transducer can be operatively coupled to the recording unit 12 by any suitable means known in the art.

The drilling rig 10 in this embodiment includes a sensor, shown generally at 14A, and called a "hookload sensor". which measures a parameter related to the weight suspended by the drawworks 11 at any point in time. Such weight measurement is known in the art by the term "hookload." As is known in the art, when the drill string is coupled to the top drive 14, the amount of hookload measured by the hookload sensor 14A will include the drill string weight and the weight of the top drive 14. During rig operations in which the top drive 14 is disconnected from the drill string, the weight measured by the hookload sensor 14A will be substantially only the weight of the top drive. As will by explained below with reference to FIGS. 9–12, such measurement can indicate that particular rig operations are underway, for example, "sitting in slips." The hookload sensor 14A can be operatively coupled to the recording unit 12 by any suitable means known in the art. It should be clearly understood that for purposes of defining the scope of this invention, "hookload" as used herein may include measurements of the weight suspended by the rig equipment. Hookload may also include measurements related to the weight of the drill string measured more directly, such as using an "instrumented top sub" having axial strain gauges therein. One such instrumented top sub is sold under the trade name ADAMS by Baker Hughes, Inc., Houston, Tex.

The drilling rig 10 in this embodiment also includes a torque and rotary speed ("RPM") sensor, shown generally at 14B. The sensor 14B measures the rotation rate of the top drive and drill string, and measures the torque applied to the drill string by the top drive. The torque/RPM sensor 14B can be coupled to the recording unit 12 by any suitable means known in the art.

The drilling rig 10 in this embodiment also includes a sensor, shown generally at 11A and referred to herein as a "block height sensor" for determining the vertical position of the top drive at any point in time. The block height sensor 11A can be operatively coupled to the recording unit 8 by any suitable means known in the art.

The block height sensor 11A, hookload sensor 14A and RPM/torque sensor 14B shown in FIG. 1 are only representative examples of the locations of such sensors in a drilling rig. As will be further explained with respect to various embodiments of methods according to the invention, it is only necessary to be able to determine the amount of axial force needed to move the drill string, the amount of torque needed to move the drill string and/or its rotation rate, and the axial position and/or axial velocity of the drill string. Accordingly, the positions and particular types of sensors as shown in FIG. 1 are not intended to limit the scope of the invention.

In some embodiments the recording unit 12 includes a remote communication device 44 such as a satellite transceiver or radio transceiver, for communicating data received from the MWD system 37 (and other sensors at the earth's surface) to a remote location. Such remote communication devices are well known in the art. The data detection and recording elements shown in FIG. 1, including the pressure transducer 28 and recording unit 12 are only examples of data receiving and recording systems which may be used with the invention, and accordingly, are not intended to limit the scope of the invention.

Figure 2:
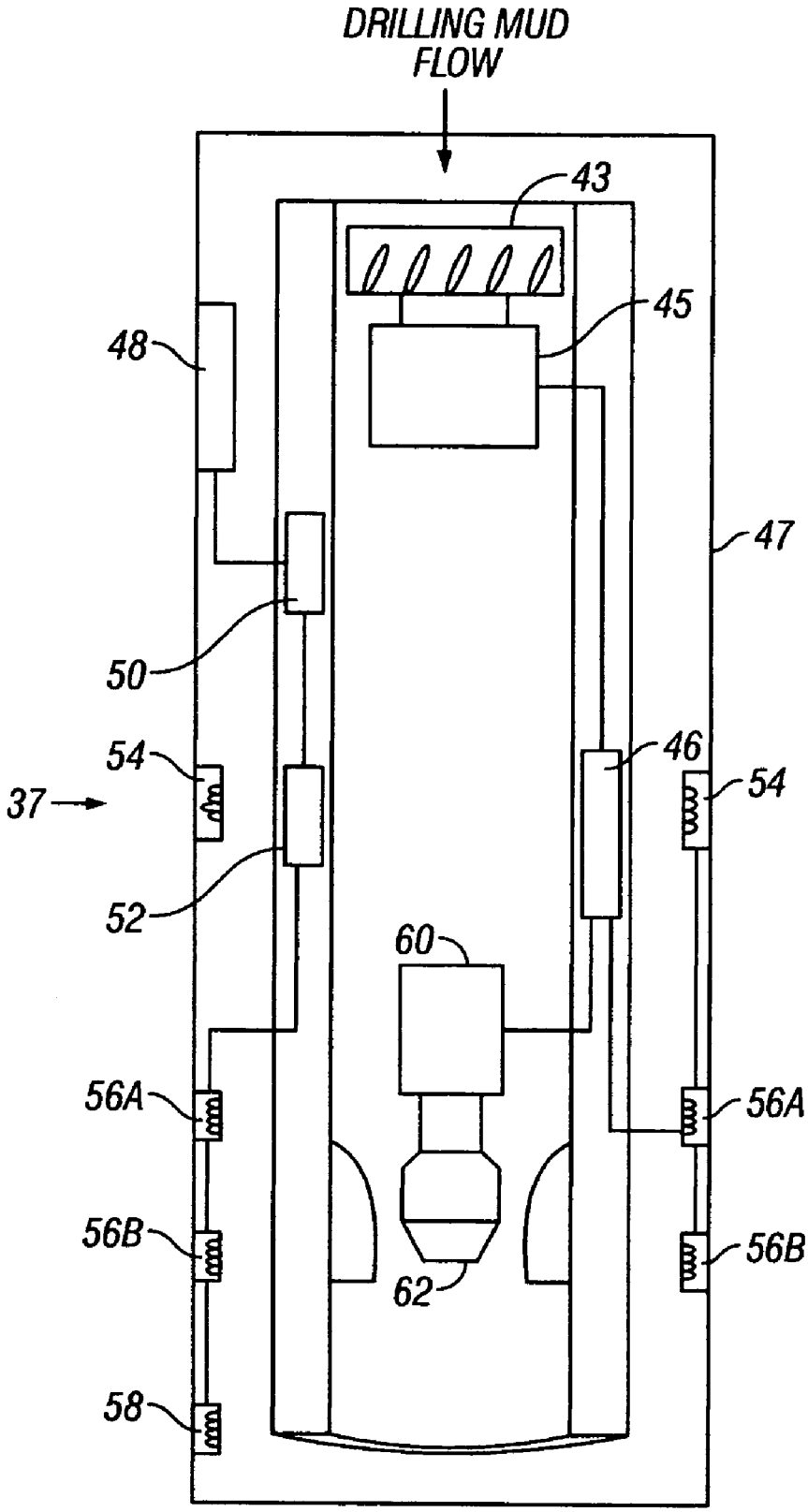
FIG. 2 shows parts of a typical MWD system.

One embodiment of an MWD system, such as shown generally at 37 in FIG. 1, is shown in more detail in FIG. 2. The MWD system 37 is typically disposed inside a non-magnetic housing 47 made from monel or the like and adapted to be coupled within the drill string at its axial ends. The housing 47 is typically configured to behave mechanically in a manner similar to other drill collars (36 in FIG. 1). The housing 47 includes disposed therein a turbine 43 which converts some of the flow of mud (18 in FIG. 1) into rotational energy to drive an alternator 45 or generator to power various electrical circuits and sensors in the MWD system 37. Other types of MWD systems may include batteries as an electrical power source.

Control over the various functions of the MWD system 37 may be performed by a central processor 46. The processor 46 may also include circuits for recording signals generated by the various sensors in the MWD system 37. In this embodiment, the MWD system 37 includes a directional sensor 50, having therein triaxial magnetometers and accelerometers such that the orientation of the MWD system 37 with respect to magnetic north and with respect to earth's gravity can be determined. The MWD system 37 may also include a gamma ray detector 48 and separate rotational (angular)/axial accelerometers, magnetometers, pressure transducers or strain gauges, shown generally at 58. The MWD system 37 may also include a resistivity sensor system, including an induction signal generator/receiver 52, and transmitter antenna 54 and receiver 56A, 56B antennas. The resistivity sensor can be of any type well known in the art for measuring electrical conductivity or resistivity of the formations (13 in FIG. 1) surrounding the wellbore (22 in FIG. 1). In some embodiments, the MWD system includes a pressure sensor 49 configured to measure fluid pressure inside the drill string and/or in an annular space between the wall of the wellbore and the outside of the drill string at a position proximate the bottom of the drill string.

The central processor 46 periodically interrogates each of the sensors in the MWD system 37 and may store the interrogated signals from each sensor in a memory or other storage device associated with the processor 46. Some of the sensor signals may be formatted for transmission to the earth's surface in a mud pressure modulation telemetry scheme. In the embodiment of FIG. 2, the mud pressure is modulated by operating an hydraulic cylinder 60 to extend a pulser valve 62 to create a restriction to the flow of mud through the housing 47. The restriction in mud flow increases the mud pressure, which is detected by transducer (28 in FIG. 1). Operation of the cylinder 60 is typically controlled by the processor 46 such that the selected data to be communicated to the earth's surface are encoded in a series of pressure pulses detected by the transducer (28 in FIG. 1) at the surface. Many different data encoding schemes using a mud pressure modulator such as shown in FIG. 2 are well known in the art. Accordingly, the type of telemetry encoding is not intended to limit the scope of the invention. Other mud pressure modulation techniques which may also be used with the invention include so-called "negative pulse" telemetry, wherein a valve is operated to momentarily vent some of the mud from within the MWD system to the annular space between the housing and the wellbore. Such venting momentarily decreases pressure in the standpipe (16 in FIG. 1). Other mud pressure telemetry includes a so-called "mud siren", in which a rotary valve disposed in the MWD housing 47 creates standing pressure waves in the mud, which may be modulated using such techniques as phase shift keying for detection at the earth's surface.

In some embodiments, the measurements made by the various sensors in the MWD system 37 may be communicated to the earth's surface substantially in real time, and without the need to have drilling mud flow inside the drill string, by using an electromagnetic communication system coupled to a communication channel in the drill pipe segments themselves. One such communication channel is disclosed in Published U.S. Patent Application No. 2002/0075114 A1 filed by Hall et al. The drill pipe disclosed in the Hall et al. application includes electromagnetically coupled wires in each drill pipe segment and a number of signal repeaters located at selected positions along the drill string. Alternatively fiber-optic or hybrid data telemetry systems might be used as a communication link from the downhole processor 46 to the earth's surface.

In some embodiments, each component of the BHA (42 in FIG. 1) may include its own rotational and axial accelerometer, magnetometer, pressure transducer or strain gauge sensor. For example, referring back to FIG. 1, each of the drill collars 36, the stabilizer 38 and the bit 40 may include such sensors. The sensors in each BHA component may be electrically coupled, or may be coupled by a linking device such as a short-hop electromagnetic transceiver of types well known in the art, to the processor (46 in FIG. 2). The processor 46 may then periodically interrogate each of the sensors disposed in the various components of the BHA 40 to make motion mode determinations according to various embodiments of the invention.

For purposes of this invention, either strain gauges, magnetometers or accelerometers may be used to make measurements related to the acceleration imparted to the particular component of the BHA and in the particular direction described. As is known in the art, torque, for example, is a vector product of moment of inertia and angular acceleration. As is known in the art, magnetometers, for example, can be used to determine angular position from which angular acceleration can be determined. A strain gauge adapted to measure torsional strain on the particular BHA component would therefore measure a quantity directly related to the angular acceleration applied to that BHA component. Accelerometers and magnetometers have the advantage of being easier to mount inside the various components of the BHA, because their response does not depend on accurate transmission of deformation of the BHA component to the accelerometer, as is required with strain gauges. However, it should be clearly understood that for purposes of defining the scope of this invention, it is only necessary that the property measured be related to the component acceleration being described. An accelerometer adapted to measure rotational (angular acceleration) would preferably be mounted such that its sensitive direction is perpendicular to the axis of the BHA component and parallel to a tangent to the outer surface of the BHA component. The directional sensor 50, if appropriately mounted inside the housing 47, may thus have one component of its three orthogonal components which is suitable to measure angular acceleration of the MWD system 37.

As is well known in the art, the data acquired and recorded by the MWD system 37 is indexed with respect to time. The time interval between successive data records made by the MWD system is selected by the system operator, but the time interval is typically regular. For example, every two to five seconds each sensor is interrogated and the value at each interrogation is recorded in the processor (46 in FIG. 2). Data recorded at the earth's surface, such as torque, hook load, vertical (axial) position of the top drive and output of the mud pumps, may be recorded at different time intervals. Alternatively these measurements can be referenced to the vertical position of the top drive, recorded not on the basis of time but on the basis of the position, such as by using a position encoder coupled to a recorder (not shown in the Figures). The recording unit (12 in FIG. 1) typically can make recordings of the various sensor measurements at regular time intervals. Data which may be acquired from other sources, such as wireline well logs, and geological records, may be recorded only on the basis of depth.

Figure 3:
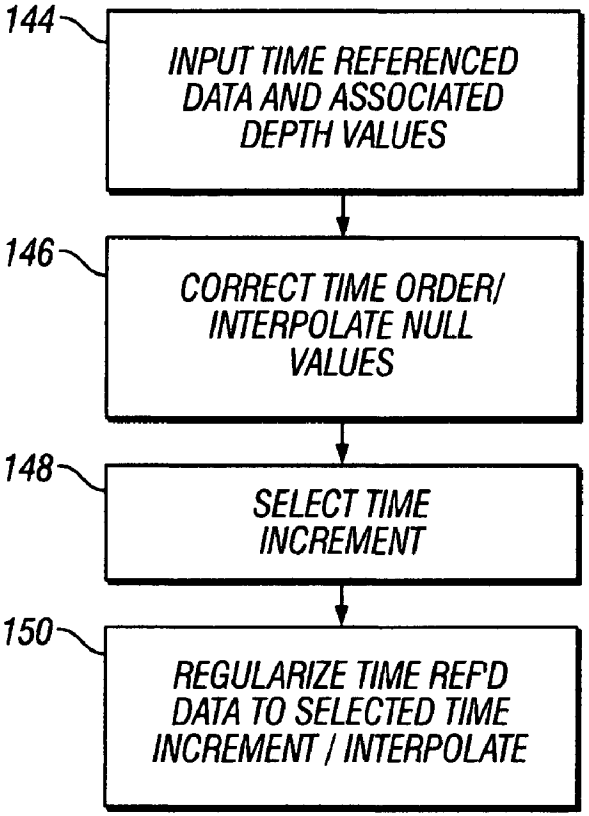
FIG. 3 is a flow chart of an example process for regularizing time referenced data to a common time reference.

In one embodiment of a method according to the invention, data from various sources are re-sampled into substantially regular time intervals, so that correlative data may be interpreted. Referring to FIG. 3, one embodiment of a time-based regularization process is shown in a flow chart. First, data which are recorded on the basis of time are input, at 144, to the recording unit (12 in FIG. 1) or other appropriately programmed computer (not shown). The input data are then adjusted such that time is monotonically increasing for all time records to correct the time order of the data, at 146. At 148, a time increment for a final output file is selected. The time increment can be any suitable value depending on the type of data being analyzed, but is typically in the range of on second to five seconds. At 150, all the data are re-sampled to the selected time increment. Values for data recorded less frequently than the selected time interval can be interpolated between time values in the final output file.

Figure 4:
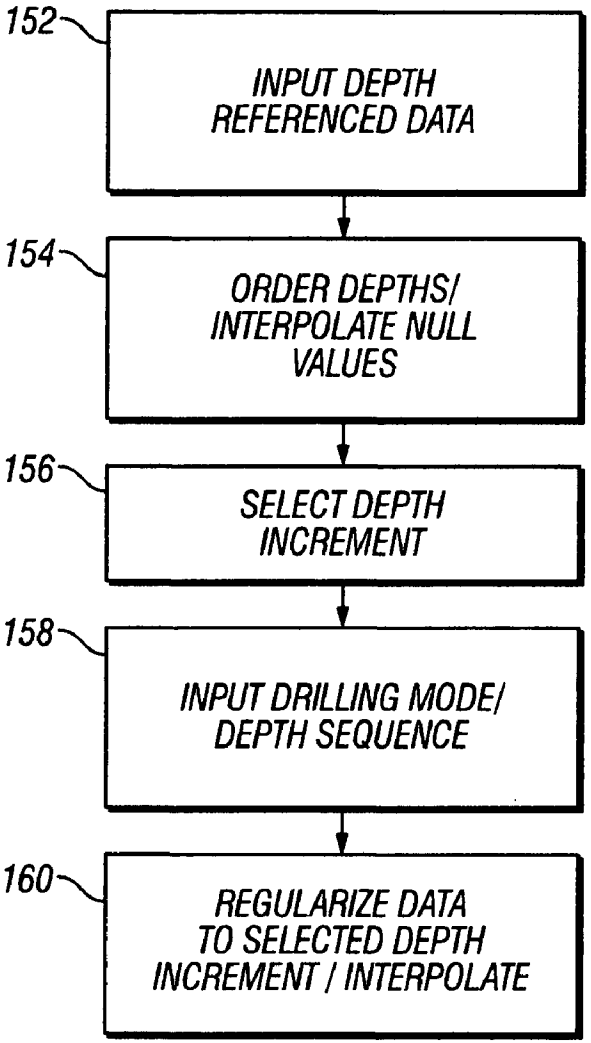
FIG. 4 is a flow chart of an example process for regularizing depth referenced data to a common depth reference.

FIG. 4 shows an example of re-sampling data recorded on the basis of depth, or on the basis of time (where a time depth record is made) to a regularly depth-spaced output file. Examples of such data would include the time-based records made in the MWD system controller, which are typically re-sampled to a depth based record for comparison to depth based wireline logs. At 152, the depth referenced data are input to the system. Whereas for time based data the respective depths may randomly increase and decrease as time increases, at 154, prior to depth based re-sampling the data samples selected from time sequences of similar drilling mode operations must be ordered such that reference depths are monotonically increasing. At 156, a depth increment is selected for the final output file. Typically the depth increment will be in a range of 0.25 feet to 2 feet. At 158, a drilling mode is input or determined from other data records made by the recording system. An example of determining the drilling mode will be explained below with respect to FIG. 8. At 160, the depth based input data are re-sampled to the selected depth interval. Data which are sampled less frequently with respect to depth may be interpolated so that a data value is present in the final output file at each and every depth.

Figure 5:
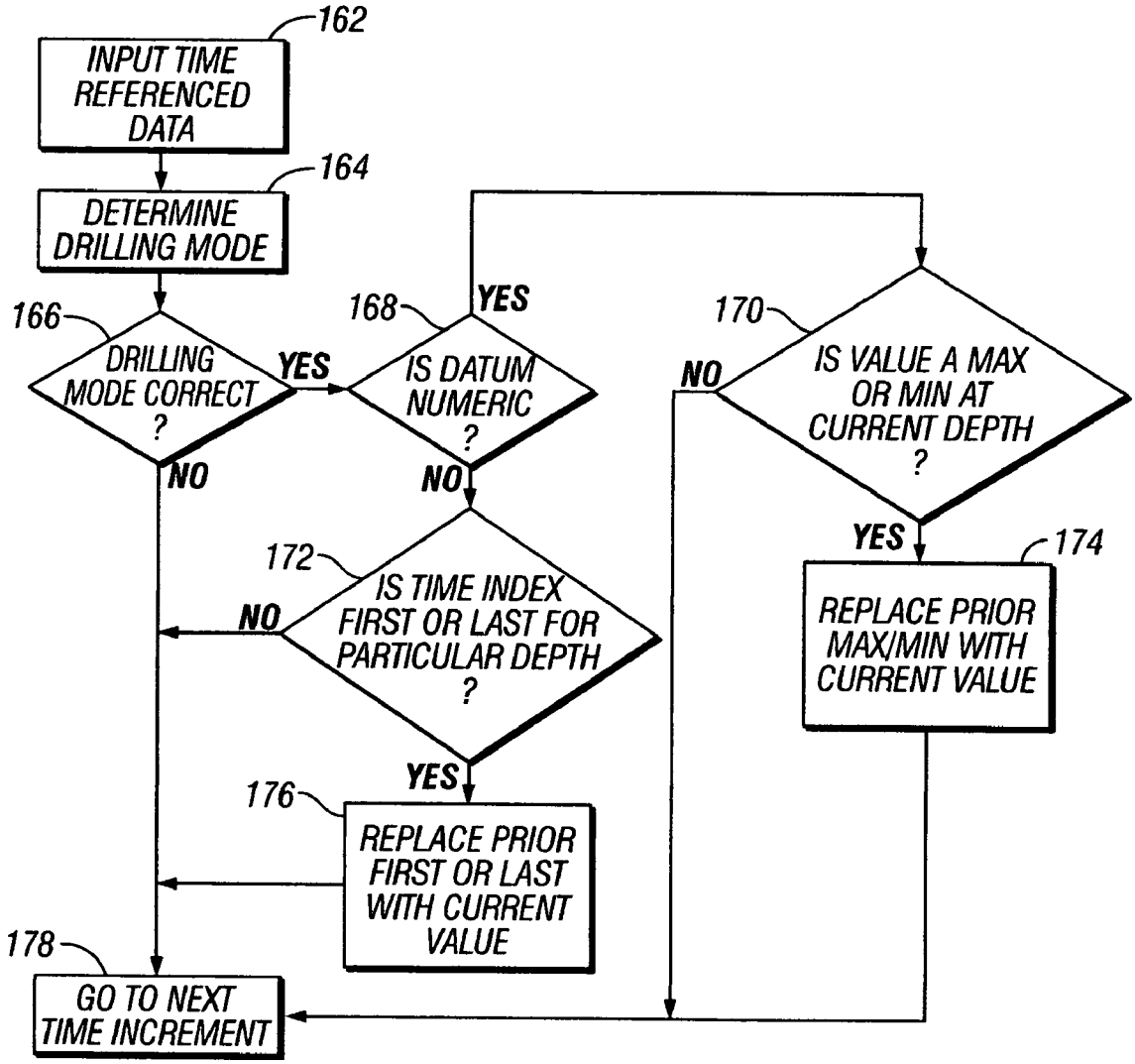
FIG. 5 is a flow chart of an example process for characterizing data attributes such as first or last at a particular depth, and maximum or minimum parameter values for a particular depth or time.

FIG. 5 shows one embodiment of a process for determining whether a particular parameter value is the first one or the last one during the progression of the drill string over a selected depth interval recorded at a particular time or approximate depth, and whether the particular parameter value is the maximum or minimum value of the particular parameter at the particular time or approximate depth. At 162, time referenced data, such as processed according to the example method of FIG. 3, are input to the system. At 164, the drilling mode is determined. At 166, the drilling mode is checked whether it is the particular drilling mode for which a comparison is to be made with respect to similar data. If the drilling mode is not the one for which a comparison is to be made, the next time increment is then selected at 178, and the process returns to checking the drilling mode, at 164, of the data from the next time increment. If the drilling mode is correct, then at 168, the data type is determined. If the data are either text or numeric, at 172, the data may be checked to determine whether the entry is the first in time or the last in time as the drill string progresses either up or down the well bore at the particular depth, within a selected interpolation window. When determining first data the time based data are scanned forwards in time with reference to either increasing or decreasing depth progression, and when determining last data the time based data are scanned backwards in time with reference to either increasing or decreasing depth progression. If the data are the first or last, at 176, then the current data value is stored in a buffer or register. Otherwise, the process goes to the next time increment, at 178. If the data are numeric, at 170 the data value may also be checked to determine whether it is the maximum or minimum value at the particular depth. If so, at 174, the current data value replaces the previously stored maximum or minimum value stored in a buffer or register. If the current value is not a maximum or minimum, the process goes to the next time increment, at 178. Generally speaking, the above example process is intended to place in time order data acquired at approximately the same depth interval in the wellbore, characterized according to the particular drilling operation or function taking place at the time the data were recorded or measured. Appropriate logic to determine the particular drilling operation can be determined, for example, from measurements of block speed, hookload, RPM and mud pump output (or standpipe pressure).

As explained above with respect to FIG. 5, parameters that are measured with respect to time can be correlated to the approximate depth in the wellbore, and to the chronological order at which each approximate depth in the wellbore is passed by the various components of the drill string. The measured parameters can also be correlated to the direction of motion of the drill string at any point in time, as well as whether the mud pumps are active at any point in time and whether the drill string is rotating. In one aspect, a comparison of selected drilling parameters can be made with respect to each time the drill string passes by each depth in the wellbore. Such comparisons of the selected parameter with respect to time may provide indications of depths in the wellbore at which drilling hazards may be encountered.

Figure 6:
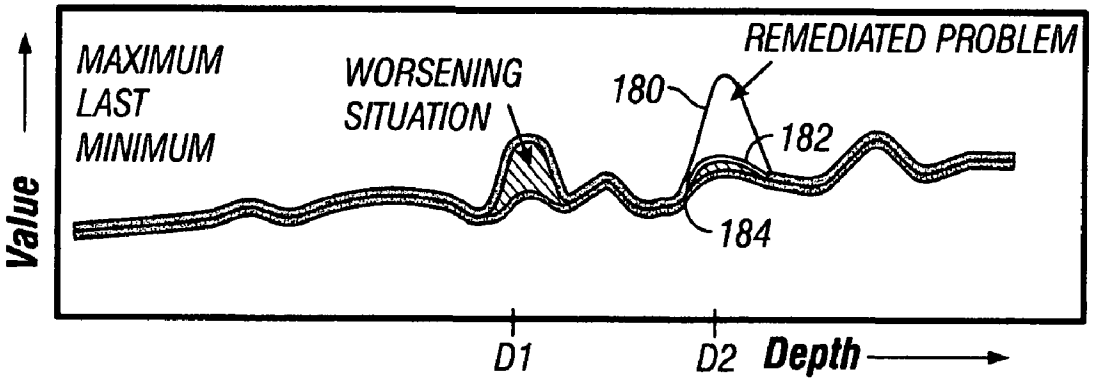
FIGS. 6 and 7 show examples of comparing data over a same depth interval acquired at different times to identify changes in a drilling operating parameter.

Examples of comparing maximum, minimum and last values of a selected parameter to identify potential drilling hazards are shown in FIG. 6. In one example, values of rotary torque (as measured by sensor 14B in FIG. 1, for example) applied during reaming operations may be plotted on the ordinate axis of the graph in FIG. 6. At each depth, a maximum, at 180, and minimum, at 184, value of torque, and the last in time value of torque, at 184, may be displayed. As may be inferred from FIG. 6, at a particular depth D1, the torque increases with respect to time. Increasing torque each time the depth D1 is passed by the BHA may indicate possible stuck pipe at a later time. At depth D2, the last recorded torque is much lower than the previously recorded maximum torque, indicating that with respect to D2 risk of becoming stuck has been reduced.

Figure 7:
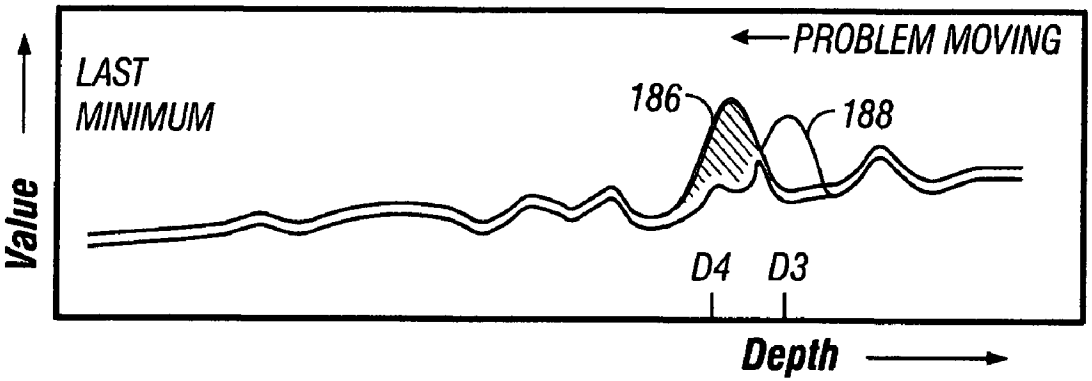

FIG. 7 shows an example of a potential stuck pipe problem moving within the wellbore. For example, a minimum torque, at 188 is shown at a relatively high value at depth D3. The last recorded torque, shown at 186, shows a peak at a shallower depth D4.

In other embodiments of a method according to this aspect of the invention, the parameter measured may be the hookload, as measured, for example by sensor 14A in FIG. 1. Other parameters that may be measured for purposes of this aspect of the invention include, without limitation the mud pump output pressure and drilling fluid pressure in the annulus (between the outside of the BHA and the wall of the wellbore), and RPM. RPM, as previously explained, can be measured using the torque/RPM sensor (14B in FIG. 1). In some embodiments, a difference between a maximum and minimum value of RPM is measured with respect to depth in the wellbore. At places where the RPM difference exceeds a selected threshold, an alarm or other signal can be generated to indicate that the particular depth may represent a drilling hazard such as settled drill cuttings when reaming through a section of the wellbore. Alternatively, maximum angular acceleration may be measured using the appropriate sensors in the MWD system (37 in FIG. 1) to determine rotational "stick-slip" tending depth intervals in the wellbore. Any parameter related to RPM and/or angular acceleration may be appropriately processed according to this embodiment in order to evaluate depth intervals in a wellbore that are susceptible to rotational stick-slip drilling hazards.

In some embodiments, if the measured parameter changes by an amount that indicates an unsafe drilling condition is expected, the system may set an alarm or provide any other indication to the drilling rig operator of the expected unsafe drilling condition. One example of the basis for setting such an alarm is determining that at a particular depth in the wellbore the torque during reaming is approaching a safe maximum, and the torque is increasing each trip into the wellbore at the particular depth. In other embodiments, a rate of change of the drilling parameter may be used to determine whether to send a warning signal. In one example the torque increases each time the drill string is inserted into the wellbore Advantageously, a system according to this aspect of the invention relieves the drilling rig operator of the need to keep track of the depths within the wellbore of possible unsafe drilling conditions, and changes in the severity of the unsafe condition over time. A particular advantage of such a system is that it removes reliance on a single drilling rig operator to record or otherwise take account of such unsafe drilling conditions. This makes possible changing the drilling rig operator without increased risk of failure to track such unsafe drilling conditions.

Figure 8:
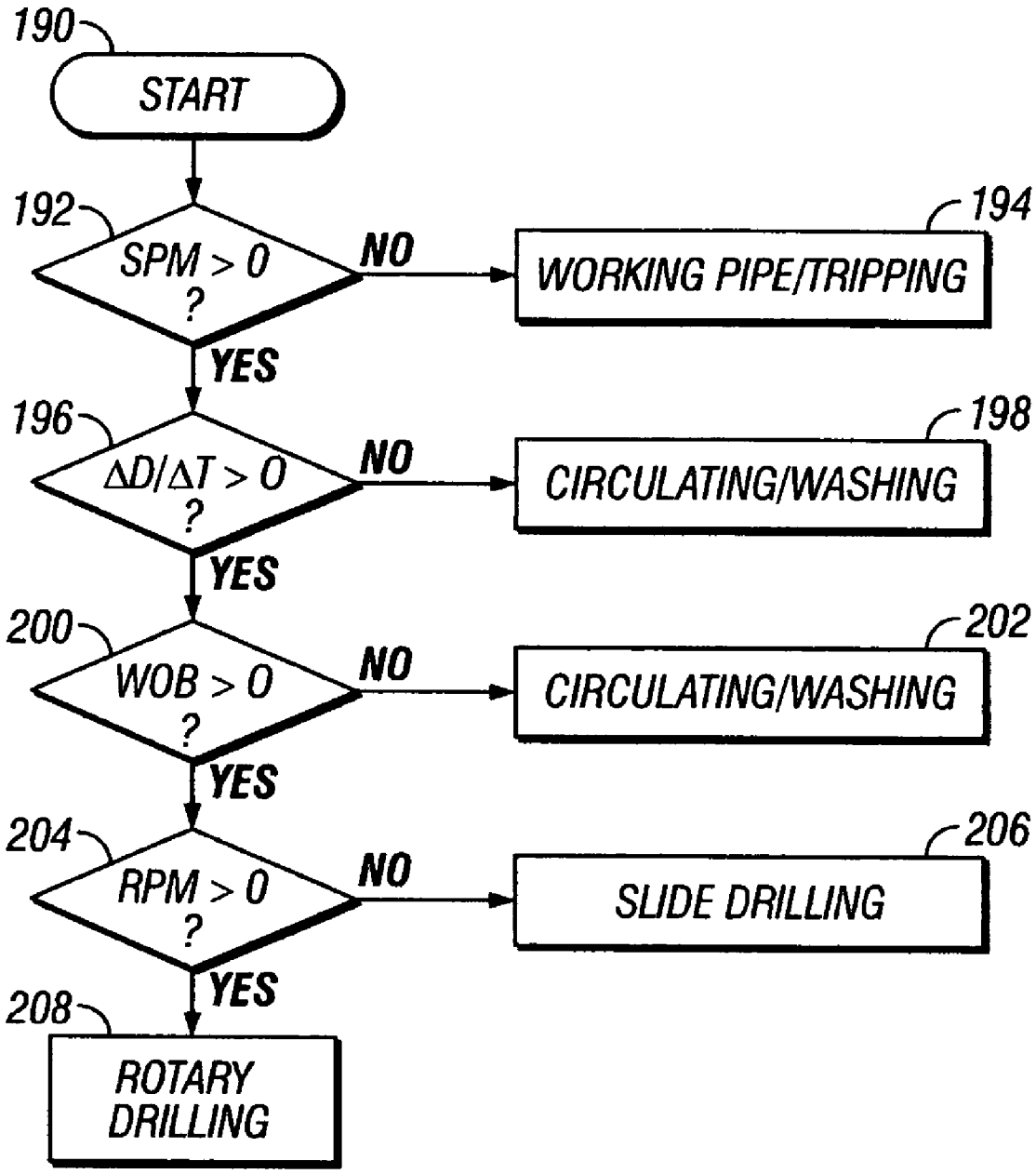
FIG. 8 shows a flow chart of an example process for identifying a drilling operating mode.

One example of determining a drilling operating mode is shown in FIG. 8. To perform the process in FIG. 8, certain parameters are measured, such as bit position, the hole depth, the hook load, the operating rate of the mud pumps, and the rotary speed of the top drive. At 190 the process begins. For example, at 192, a Boolean logic routine queries whether the mud pumps have more than zero operating rate. If not, and the bit position is changing, the bit position is less than the total wellbore depth and the drill string is not rotating (RPM=0), the drilling mode is determined to be tripping pipe in or tripping pipe out (removing or inserting the drill string into the wellbore), at 194. As another example, if the mud pump has non-zero output, at 196, the routine queries whether the change in bit depth is greater than zero with respect to time, the bit depth is less than the hole depth and the drill string is not rotating. If, with these additional conditions, the bit position is not changing, at 198, the mode is determined to be circulating. Another example is when the bit position is increasing or constant with the mud pump pressure greater than zero and bit position equal to the total wellbore depth. Under these conditions, at 204, the rotary top drive speed is interrogated. If the speed is greater than zero, at 208, the mode is rotary drilling. If the rotary speed is zero, at 206, then the mode is slide drilling. Another example is when the measured hookload is substantially equal to the weight of the top drive, the mud pump pressure (measured by transducer 28 in FIG. 1) is zero and the RPM is zero, with the bit position less than the wellbore depth. Under these conditions the drilling mode is determined to be "in slips" during such operations as adding additional length to the drill string. The foregoing are only some examples of determining drilling mode by interrogating selected data values.

Figure 9:
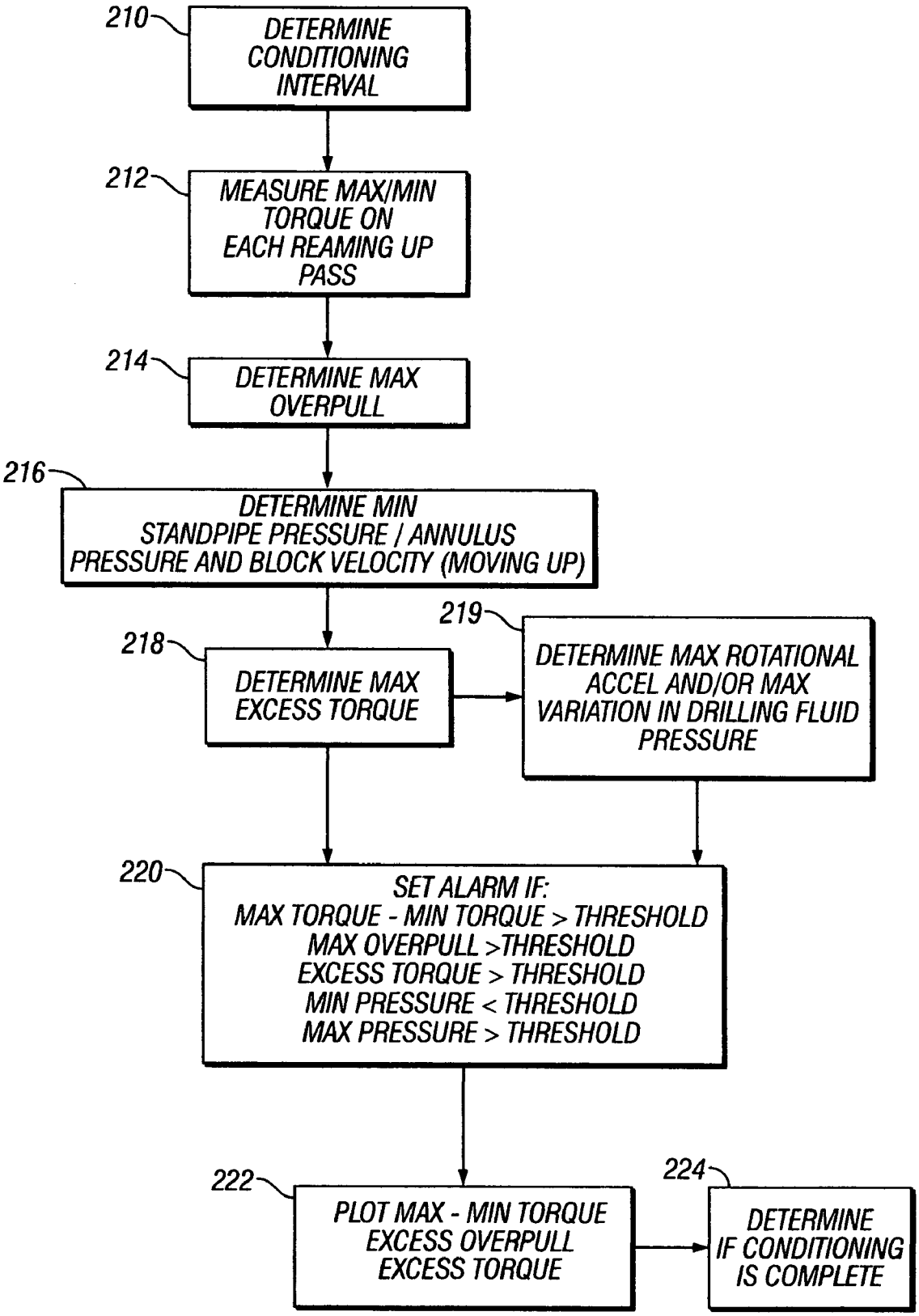
FIG. 9 is a flow chart of one embodiment of a method for determining whether conditioning prior to making a connection is complete.

Determining the drilling mode, as explained above with respect to FIG. 8, can be used in some embodiments to determine when the drilling mode is "conditioning" the wellbore prior to adding another segment of drill pipe ("making a connection"). In one embodiment, a conditioning time is determined to end by measuring when the hookload drops to the weight of the hook or top drive (indicating that the drill string has been disconnected from the top drive or kelly), when the stand pipe pressure, for example as measured by transducer 28 in FIG. 1, drops to zero (indicating that the mud pumps are turned off) and when the RPM, as measured by sensor 14B in FIG. 1 equals zero. The conditioning time is determined to begin at the latest time at which the drill bit (40 in FIG. 1) is lifted from the bottom of the wellbore (bit position is less than total wellbore depth), prior to the end of conditioning time. Referring to FIG. 9, the beginning of the conditioning time is determined at 210. During conditioning, the mud pump (18 in FIG. 1) is operated, and the drill string is typically rotated while the drill string is raised and lowered. The pump or standpipe pressure (and annulus pressure if sensor 49 in FIG. 2 is included in the MWD system) is measured, rotational acceleration of a drill string component is measured, rotary torque is measured and hookload is measured. The hook position is also measured, using, for example, sensor 11A in FIG. 1. The total time of conditioning for each such conditioning interval is measured. The purpose of measuring the time elapsed for each conditioning interval will be further explained below with reference to FIG. 10.

In the present embodiment, a difference between the maximum measured torque and the minimum measured torque (measured at the surface by sensor 14B in FIG. 1 and/or downhole in the MWD system 37 in FIG. 1 using sensor 49, for example) is determined within a specified time and/or depth interval, at 212. At 214, a maximum "overpull" is determined for each movement of the drill string upward during conditioning ("reaming up"). Overpull is defined as an amount of hookload which exceeds the expected hookload needed to withdraw the drill string from the wellbore. The expected hookload may be determined by modeling. One model known in the art is a computer program sold under the trade name WELLPLAN by Landmark Graphics, Houston, Tex. At 216 the minimum standpipe pressure (or minimum annulus pressure) is determined for each upward movement of the drill string during conditioning. A maximum annulus or standpipe pressure is also measured during each downward movement of the drill string. At 218, a maximum excess torque is determined. Excess torque is defined as the amount of torque exerted to rotate the drill string which exceeds the expected torque. The expected torque, similarly to the expected hookload, can be determined using a model such as the previously described WELLPLAN computer program. At 219, the maximum rotational acceleration of a drill string component and the maximum variation in standpipe and/or downhole annulus pressure within a selected time and/or depth interval are determined.

In the present embodiment, at 220, an alarm may be set, or some other indication or signal may be provided to the wellbore operator or the drilling rig operator if one or more of the following conditions occurs. First, if the difference between the maximum and minimum torque exceeds a selected threshold, the alarm may be set. Second, if the maximum excess torque exceeds a selected threshold, the alarm may be set. Third, if the minimum standpipe or annulus pressure drops below a level necessary to restrain fluid pressure in the formations, or to maintain mechanical stability of the wellbore during upward movement of the drill string during conditioning, the alarm may be set. Conversely, if the maximum standpipe or annulus pressure exceeds an amount which is determined to be safe (typically the formation fracture pressure less a safety margin), the alarm may be set. Additionally, if the maximum overpull exceeds a selected threshold, the alarm may be set. Also if the maximum drill string component rotational acceleration and/or variation of standpipe pressure and/or downhole annular pressure within a specified time and/or depth interval is greater than a selected threshold, the alarm may be set. Expressed generally, the present embodiment includes measuring at least one of a parameter related to drill string rotation, a parameter related to drill string axial motion and a parameter related to drilling fluid pressure. If any of the measured parameters exceeds a selected threshold, then an alarm may be set or a warning signal generated. The foregoing examples are illustrative of the general concept of this embodiment of the invention.

At 222, the difference between the maximum and minimum measured torque values is determined for each successive upward and downward movement of the drill string during conditioning. Similarly, an amount of maximum overpull is determined for each successive upward movement of the drill string during conditioning. Maximum drill string component rotational acceleration and/or maximum variation of standpipe pressure and/or maximum variation of downhole annular pressure within a specified time and/or depth interval is determined for each successive upward movement of the drill string during conditioning. Finally, maximum excess torque is determined during each movement of the drill string during conditioning. At 224, if the difference between maximum torque and minimum torque, or if the maximum drill string component acceleration or maximum variation of standpipe pressure or maximum variation in downhole annular pressure within a specified time and/or depth interval drops below a selected threshold during any particular upward or downward movement of the drill string during conditioning, an indication, alarm or other signal may be sent to the drilling rig operator or to the wellbore operator to indicate that it is safe to end the conditioning process. Alternatively, at 224, if the maximum overpull drops below a selected threshold during any upward drill string movement during conditioning, a signal may be sent indicating that it is safe to end the conditioning process. Finally, if the maximum excess torque drops below a selected threshold, then a signal may be sent indicating that it is safe to end the conditioning process.

In other embodiments, combinations of any or all of the maximum/minimum torque difference, maximum overpull, maximum excess torque and maximum drill string component rotational acceleration or maximum variation of standpipe pressure or maximum variation in downhole annular pressure within a specified time and/or depth interval may be determined for each drill string motion and compared to respective thresholds to determine whether to send a signal or indication that it is safe to end the conditioning process. Advantageously, embodiments of a method according to this aspect of the invention provide the drilling rig operator or the wellbore operator with a reliable indication that conditioning is safe to end. Prior art methods, which are primarily based on visual observation of drilling rig instrumentation, do not provide any repeatable, reliable indication of whether it is safe to end conditioning, which may result in excess conditioning time (and corresponding wasted rig time) or insufficient conditioning time (which may cause stuck pipe or other catastrophic drilling failure event).

In another aspect, a method according to the invention includes determining an interval of time called "time in slips." As previously explained with respect to FIG. 9, an end time of conditioning the wellbore is determined when the drill string is "put into the slips", and thus is the beginning of the time in slips. For purposes of defining the invention, the beginning of in slips time is determined, as explained above, by measuring when the hookload drops to the weight of the hook or top drive (indicating that the drill string has been disconnected from the top drive or kelly), when the stand pipe pressure drops to zero (indicating that the mud pumps are turned off) and when the RPM equals zero. An end of the time in slips is defined as the latest time, after the beginning of in slips time, when the pumps are off, RPM is zero and hookload is equal to the top drive or hook weight prior to the bit being returned to the bottom of the wellbore (bit position is subsequently equal to hole depth). The time in slips according to this aspect of the invention is measured for each "connection" (coupling of an additional segment of drill pipe to deepen the wellbore). The purpose for measuring the time in slips for each connection will be further explained below.

Another interval of time is between the end of "in slips" time when the top drive or kelly is reconnected to the drill string, and subsequently when the drill bit is on the bottom of the wellbore (bit position is again equal to hole depth), and at least part of the weight of the drill string is transferred to the drill bit. This time interval may be referred to as the "time to resume drilling."

Another time interval used in some embodiments of a method according to the invention is referred to as the "time not circulating." The time not circulating is a superset of the "time in slips" and includes all the time between turning the mud pumps off prior to the end of conditioning and the resumption of drilling during which time the mud pumps are turned off.

Figure 10:
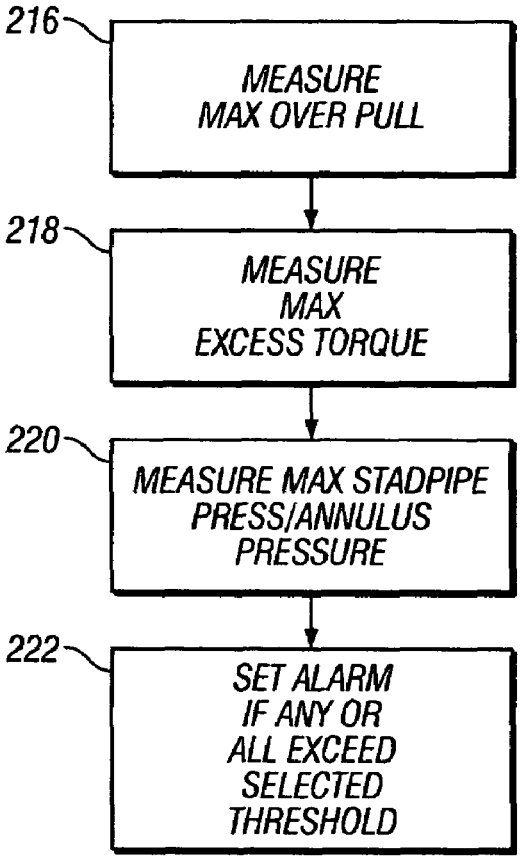
FIG. 10 is a flow chart of one embodiment of a method for determining unsafe conditions during resumption of drilling after making a connection.

Referring to FIG. 10, in one embodiment, a maximum overpull is measured during the time to resume interval as each new segment of drill pipe is added to the drill string and the entire drill string is lifted out of the slips to resume drilling, as shown at 216. At 218, a maximum excess torque is measured. At 220, a maximum standpipe pressure (or annulus pressure if such a sensor is included in the MWD system) is measured. At 222, any one or more of the maximum overpull, maximum excess torque and maximum standpipe/annulus pressure is compared to a respective threshold. If any one or more of the measured parameters exceeds its respective threshold, an alarm or other indication may be sent to the wellbore operator or the drilling rig operator.

Figure 11:
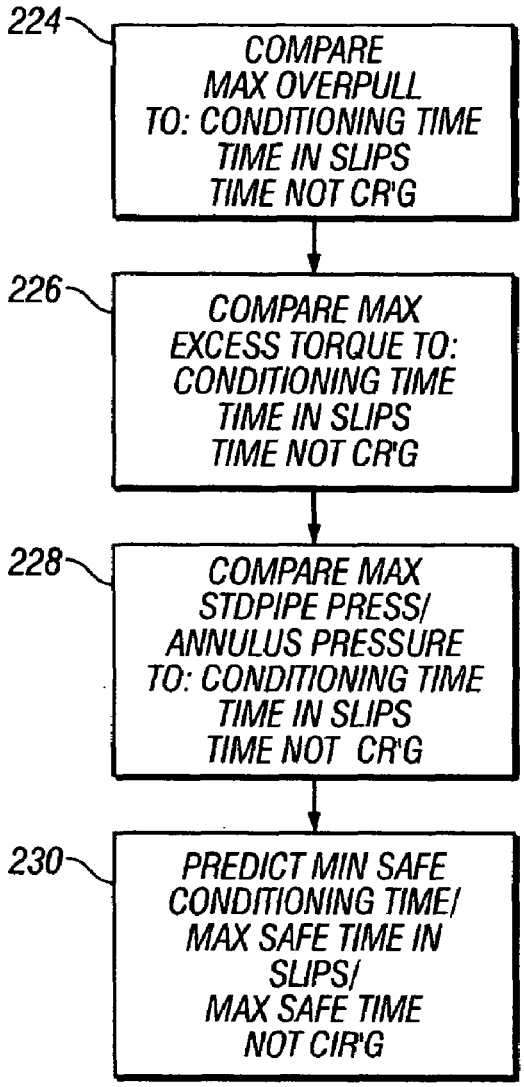
FIG. 11 is a flow chart of one embodiment of a method for determining maximum safe time in slips and time not circulating, and minimum safe conditioning time.

In another embodiment, and referring to FIG. 11, at 224, for each connection, during the time to resume drilling, the maximum overpull is measured, and the conditioning time, the time in slips and the time not circulating are determined for that connection. At 226, for the same connection, the maximum excess torque is measured during the time to resume drilling. At 228, the maximum standpipe pressure (or annulus pressure if the MWD system includes an annulus pressure sensor) is measured during the time to resume.

At 230, for each connection the maximum overpull, maximum excess torque and the maximum standpipe/annulus pressure are each compared to the time in slips, time not circulating and conditioning time associated with each connection. As a result of the comparing, a maximum amount of safe time in slips and safe time not circulating can be determined with respect to a relationship between the time in slips and the time not circulating and any one or more of the maximum overpull, maximum excess torque and maximum pressure. Correspondingly, a minimum amount of safe conditioning time can be determined from comparing the conditioning time to any one or more of the maximum overpull, maximum excess torque and maximum pressure.

The maximum time in slips and/or maximum time not circulating can be compared to the measured elapsed time measured during the same events in subsequent connections. If the measured elapsed time in any subsequent connection approaches or exceeds either or both the determined maximum safe times, an indication or signal can be sent to the drilling rig operator or the wellbore operator, or an alarm can be set. Correspondingly, an alarm can be set or other signal can be sent if subsequent conditioning times are determined to be less than the safe conditioning time.

Figure 12:
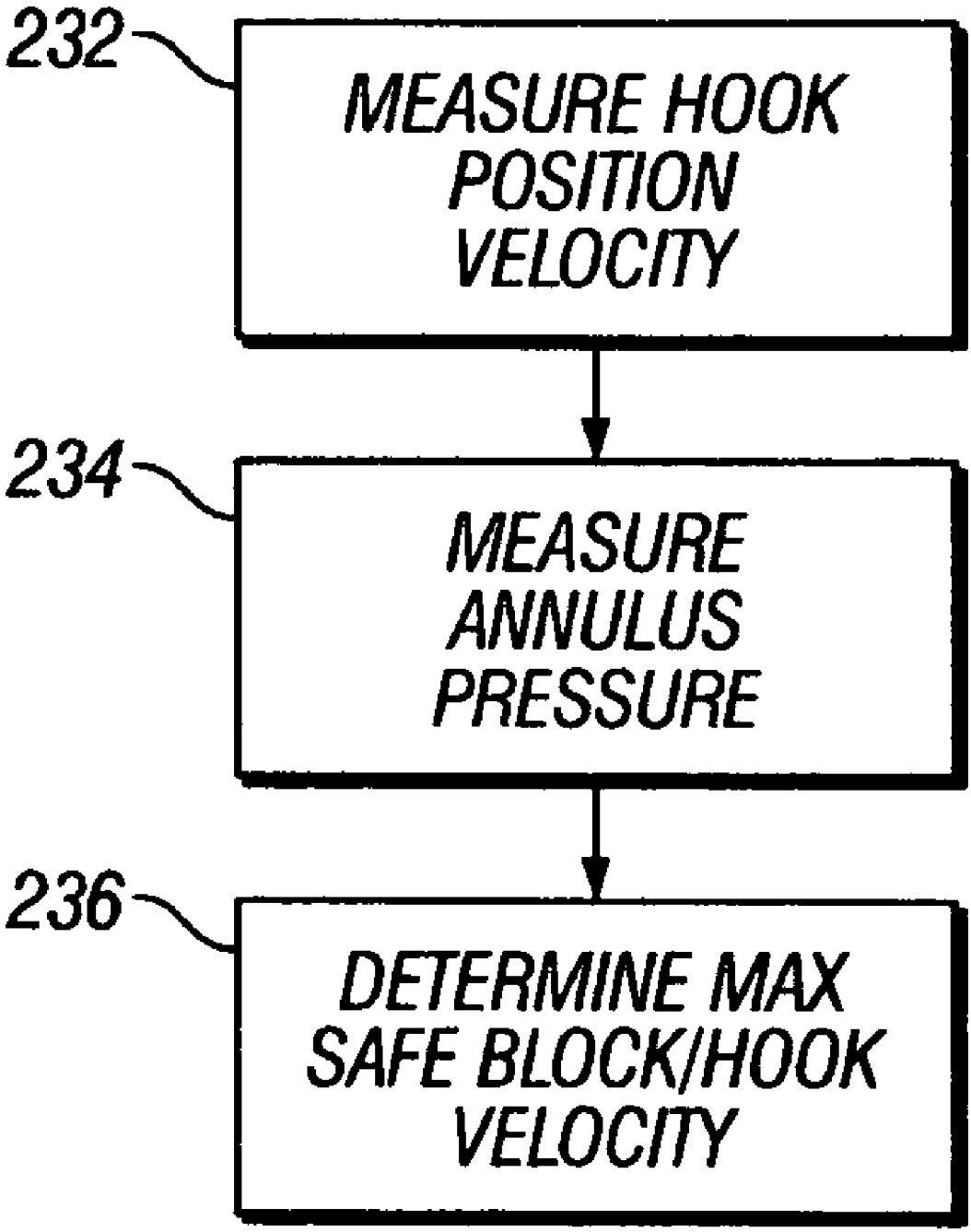
FIG. 12 is a flow chart of one embodiment of a method for determining a maximum safe "block speed."

Another aspect of the invention will now be explained with reference to FIG. 12. As is known in the art, while moving the drill string into and out of the wellbore during "tripping" or when reaming (such as during conditioning time intervals described above), it is important to avoid moving the drill string at a speed which would result in drilling fluid pressure above or below respective safe levels. Drilling fluid pressure is related to speed and/or acceleration of pipe movement, as is known the art, because of effects known as "swab", wherein pressure is reduced by the suction effect of moving the drill string out of the wellbore, and "surge", wherein pressure is increased by moving the drill string into the wellbore. At 232 in FIG. 12, the vertical position of the top drive (14 in FIG. 1) or hook is measured using the previously described block position sensor (11A in FIG. 1). In some embodiments, the top drive or hook position may be converted into a value at each moment in time of hook or top drive velocity. In other embodiments, a top drive or velocity sensor may be used. Irrespective of the particular hardware implementation, the process according to this aspect of the invention determines hook or top drive axial velocity and acceleration at each time during tripping in or tripping out. Alternatively, the block axial speed may be determined from the sensor (11A in FIG. 1) measurements, along with a determination, such as from the operating characteristics of the drawworks (11 in FIG. 1) of the direction of axial motion of the top drive (14 in FIG. 1) For each same time, at 234, drilling fluid pressure is measured by the pressure sensor (49 in FIG. 2) in the MWD system (37 in FIG. 2). Each of the measurements of annulus pressure, top drive velocity and top drive axial acceleration are also correlated to the bit depth in the wellbore at each same time. A relationship is then generated between top drive velocity and annulus pressure within selected depth intervals. Similar relationships may be developed between top drive maximum axial accelerations and maximum annular pressure measured within a specified time interval subsequent to the maximum acceleration and top drive maximum axial acceleration and minimum annular pressure measured within a specified time interval subsequent to the maximum acceleration. In one embodiment, the selected depth intervals are about 1,000 ft (300 m). Then, at 236, for each depth interval, a maximum safe top drive speed and axial acceleration is calculated, based on the relationships determined, for both tripping in and tripping out. The maximum top drive velocity tripping out is that which will result in a swab pressure not below a safe minimum. A safe minimum pressure is typically the fluid pressure in the exposed earth formations plus a safety factor. Correspondingly, a maximum velocity tripping in is one that will result in a surge pressure below a safe pressure. A safe surge pressure is typically a fracture pressure of the exposed earth formations less a safety factor. Similar safe top drive acceleration limits can be determined from the same earth formation fluid and fracture pressures with their corresponding safety factors.

As a practical matter, measurements made by the pressure sensor (49 in FIG. 2) in the MWD system (37 in FIG. 2) cannot be transmitted to the earth's surface using mud pressure modulation telemetry systems known in the art during operations in which the mud pump (18 in FIG. 1) is not operating. Therefore, it may be more practical during such operations to use electromagnetic MWD telemetry systems known in the art, or to use the signal channel disclosed in the previously referred to Published U.S. Patent Application No. 2002/0075114 A1 filed by Hall et al. in order to transmit the pressure measurements to the recording unit (8 in FIG. 1).

In some embodiments, an alarm or other signal or indication can be communicated to the drilling rig operator if the top drive velocity or acceleration exceeds the safe values either tripping in or tripping out.

Methods according to the various aspects of the invention can be embodied in computer code stored in a computer readable medium such as a compact disk or magnetic diskette. Such computer code will cause a programmable general purpose computer to execute steps according to the various aspects of the invention as described above.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for identifying potential drilling hazards in a wellbore, comprising:

measuring a drilling parameter;

correlating the drilling parameter to a depth in the wellbore at which selected components of a drill string pass;

determining changes in the measured parameter each time the selected components of the drill string pass selected depths in the wellbore; and generating a warning signal in response to the determined changes in the measured parameter.

2. The method of claim 1 further comprising determining a drilling mode and correlating the measured parameter to times at which the drilling mode is the same.

3. The method of claim 2 wherein the drilling mode comprises at least one of tripping in, tripping out, washing down, pumping out, reaming in and reaming out.

4. The method of claim 1 wherein the measured drilling parameter comprises at least one of a parameter related to hookload, a parameter related to rotary torque, a parameter related to drill string rotation rate, a parameter related to drilling fluid pressure, and a parameter related to block speed.

5. The method of claim 1 wherein the warning signal is generated when the parameter exceeds a selected threshold.

6. The method of claim 1 wherein the warning signal is generated when an amount of change in the parameter exceeds a selected threshold.

7. A method for determining potential drilling hazards in a wellbore, comprising:

determining times at which a drilling system is conditioning the wellbore;

measuring at least one of a parameter related to drill string rotation, a parameter related to drill string axial motion and a parameter related to drilling fluid pressure during the conditioning;

generating a warning signal if at the at least one parameter exceeds a selected threshold during the conditioning.

determininig a value of at least one of a difference between a maximum and a minimum measured torque, a variation in torque a maximum value of rotational acceleration and drilling fluid pressure variation each of a plurality of times the drilling system is conditioning; and generating a signal that the conditioning is substantially complete when selected ones of the value of the difference between the maximum and minimum measured torque, the maximum value of rotational acceleration and the fluid pressure variation drop below a selected threshold.

8. The method of claim 7 wherein the parameter related to drill string rotation comprises torque.

9. The method of claim 7 wherein the parameter related to axial motion comprises hookload.

10. The method of claim 7 wherein the drilling fluid pressure comprises annulus pressure.

11. The method of claim 7 wherein the drilling fluid pressure comprises standpipe pressure.

12. A method for determining potential drilling hazards in a wellbore, comprising:

determining when a drilling system is static, wherein drilling fluid pumps are not operating and a drill string is not moving;

during a period during which the drilling system resumes drill string movement and fluid pump operation following when the drilling system is static, measuring at least one of a maximum torque, a maximum hookload and a maximum drilling fluid pressure; and generating a warning signal if the at least one of the maximum torque, the maximum hookload and the maximum drilling fluid pressure exceeds a respective selected threshold.

13. The method of claim 12 wherein at least one of an expected hookload, an expected torque and a maximum safe drilling fluid pressure is determined from a mathematical model of the drilling system and the wellbore.

14. A method for determining whether conditioning a wellbore prior to making a connection is substantially completed, comprising:

measuring a length of conditioning time prior to each connection;

measuring at least one of a maximum hookload, a maximum torque and a maximum drilling fluid pressure during a resuming drilling time after each connection time; and determining a minimum safe conditioning time from a correlation between the measured conditioning time lengths and the measured at least one maximum hookload, maximum torque and maximum drilling fluid pressure during a time of resuming drilling for each connection.

15. The method of claim 14 further comprising measuring a time in slips for each connection and determining a maximum safe time in slips from a correlation of the measured time in slips to the measured at least one of maximum hookload, maximum torque and maximum drilling fluid pressure for each connection.

16. The method of claim 14 further comprising measuring a time not circulating for each connection and determining a maximum safe time not circulating from a correlation of the measured time not circulating to the measured at least one maximum hookload, maximum torque and maximum drilling fluid pressure during a time of resuming drilling for each connection.

17. A method for determining a safe maximum value of a parameter related to speed of motion of a drill string during drilling operations, comprising:

measuring a drilling fluid pressure;

measuring at least one parameter related to speed of motion of the drill string along the wellbore;

determining a relationship between the measured parameter and the drilling fluid pressure; and generating a warning signal when the measured parameter correlates to a drilling fluid pressure approaching a safety limit.

18. The method of claim 17 wherein the drill string is moved out of the wellbore and the safety limit comprises a minimum value of drilling fluid pressure related to a fluid pressure of exposed earth formations.

19. The method of claim 17 wherein the drill string is moved into the wellbore and the safety limit comprise a maximum value of drilling fluid pressure related to a fracture pressure of exposed earth formations.

20. The method of claim 17 wherein the drilling fluid pressure is measured in an annular space between the drill string and a wall of the wellbore.

21. A program stored in a computer readable medium, the program including logic operable to cause a programmable computer to perform steps comprising:

measuring a drilling parameter;

correlating the measured drilling parameter to a depth in the wellbore at which selected components of a drill string pass;

determining changes in the measured parameter each time the selected components of the drill string pass selected depths in the wellbore; and generating a warning signal in response to the determined changes in the measured parameter.

22. The program of claim 21 further comprising logic operable to cause the computer to perform determining a drilling mode and correlating the measured parameter to times at which the drilling mode is the same.

23. The program of claim 22 wherein the drilling mode comprises at least one of tripping in, tripping out, washing down, pumping out, reaming in and reaming out.

24. The program of claim 21 wherein the measured drilling parameter comprises at least one of a parameter related to hookload, a parameter related to rotary torque, a parameter related to a drill string component rotation rate, a parameter related to standpipe pressure, a parameter related to drilling fluid pressure, and a parameter related to block speed.

25. The program of claim 21 wherein the warning signal is generated when the parameter exceeds a selected threshold.

26. The program of claim 21 wherein the warning signal is generated when an amount of change in the parameter exceeds a selected threshold.

27. A program stored in a computer readable medium, the program containing logic operable to cause a programmable computer to perform steps comprising:

determining times at which a drilling system is conditioning the wellbore;

measuring at least one of a parameter related to drill string rotation, a parameter related to drill string axial motion and a parameter related to drilling fluid pressure;

generating a warning signal if at the at least one parameter exceeds a selected threshold during the conditioning;

determining a value of at least one of a difference between a maximum and a minimum measured torque, a variation in torque a maximum value of rotational acceleration and drilling fluid pressure variation each of a plurality of times the drilling system is conditioning; and generating a signal that the conditioning is substantially complete when selected ones of the value of the difference between the maximum and minimum measured torque, the maximum value of rotational acceleration and the fluid pressure variation drop below a selected threshold.

28. The program of claim 27 wherein the parameter related to drill string rotation comprises torque.

29. The program of claim 27 wherein the parameter related to axial motion comprises hookload.

30. The program of claim 27 wherein the drilling fluid pressure comprises annulus pressure.

31. The program of claim 27 wherein the drilling fluid pressure comprises standpipe pressure.

32. A program stored in a computer readable medium, the program including logic operable to cause a programmable computer to perform steps comprising:

measuring a drilling fluid pressure;

measuring a parameter related to a speed of motion of the drill string along the wellbore;

determining a relationship between the measured parameter and the drilling fluid pressure; and generating a warning signal when the measured parameter correlates to a drilling fluid pressure approaching a safety limit.

33. The program of claim 32 wherein the drill string is moved out of the wellbore and the safety limit comprises a minimum value of drilling fluid pressure related to a fluid pressure of exposed earth formations.

34. The program of claim 32 wherein the drill string is moved into the wellbore and the safety limit comprise a maximum value of drilling fluid pressure related to a fracture pressure of exposed earth formations.

35. The program of claim 32 wherein the drilling fluid pressure is measured in an annular space between the drill string and a wall of the wellbore.

36. A computer program stored in a computer readable medium, the program including logic operable to cause a programmable computer to perform steps comprising:

measuring a conditioning time prior to each of a plurality of drill string connections;

measuring at least one of a maximum hookload, a maximum torque and a maximum drilling fluid pressure during a resuming drilling time after each of the connections; and determining a minimum safe conditioning time from a correlation between the measured conditioning times and the measurement of at least one of maximum hookload, maximum torque and maximum drilling fluid pressure during a time of resuming drilling for each connection.

37. The program of claim 36 further comprising logic operable to cause the computer to perform measuring a time in slips for each connection and determining a maximum safe time in slips from the measured time in slips and the measurement of at least one of maximum hookload, maximum torque and maximum drilling fluid pressure during a time of resuming drilling for each connection.

38. The program of claim 36 further comprising logic operable to cause the computer to perform measuring a time not circulating for each connection and determining a maximum safe time not circulating from the measured time not circulating and the measurement of at least one of maximum hookload, maximum torque and maximum drilling fluid pressure during a time of resuming drilling for each connection.

39. A computer program stored in a computer readable medium, the program having logic operable to cause a programmable computer to perform steps comprising:

determining when a drilling system is static, wherein drilling fluid pumps are not operating and a drill string is not moving;

during a period during which the drilling system resumes drill string movement and fluid pump operation following when the drilling system is static, measuring at least one of a maximum torque, a maximum hook load and a maximum drilling fluid pressure; and generating a warning signal if the at least one of the maximum torque, the maximum hook load and the maximum drilling fluid pressure exceeds a respective selected threshold.

40. The program of claim 39 wherein at least one of an expected hookload, an expected torque and a maximum safe drilling fluid pressure is determined from a mathematical model of the drilling system and the wellbore.

41. A method for determining a maximum safe time in slips comprising:

measuring a time in slips for each connection;

measuring at least one of a maximum hookload, a maximum torque and a maximum drilling fluid pressure during a resuming drilling time after each connection time; and determining a maximum safe time in slips from a correlation of the measured time in slips to the measured at least one of maximum hookload, maximum torque and maximum drilling fluid pressure for each connection.

42. The method of claim 41 further comprising measuring a time not circulating for each connection and determining a maximum safe time not circulating from a correlation of the measured time not circulating to the measured at least one maximum hookload, maximum torque and maximum drilling fluid pressure during a time of resuming drilling for each connection.

43. A computer program stored in a computer readable medium, the program comprising logic operable to cause a programmable computer to perform steps comprising:

measuring a time in slips for each connection;

measuring at least one of a maximum hookload, a maximum torque and a maximum drilling fluid pressure during a resuming drilling time after each connection time; and determining a maximum safe time in slips from a correlation of the measured time in slips to the measured at least one of maximum hookload, maximum torque and maximum drilling fluid pressure for each connection.

44. The program of claim 43 further comprising logic operable to cause the computer to perform measuring a time not circulating for each connection and determining a maximum safe time not circulating from the measured time not circulating and the measurement of at least one of maximum hookload, maximum torque and maximum drilling fluid pressure during a time of resuming drilling for each connection.

* * * * *